US010844823B2

(12) United States Patent
Koehler

(10) Patent No.: US 10,844,823 B2
(45) Date of Patent: Nov. 24, 2020

(54) ENGINE STARTER ATTACHMENTS FOR DRILL/DRIVER GUN

(71) Applicant: Skunk Works, LLC, Moonachie, NJ (US)

(72) Inventor: Robert H. Koehler, Secaucus, NJ (US)

(73) Assignee: Skunk Works, LLC, Moonachie, NJ (US)

( * ) Notice: Subject to any disclaimer, the term of this patent is extended or adjusted under 35 U.S.C. 154(b) by 0 days.

(21) Appl. No.: 16/226,934

(22) Filed: Jan. 31, 2019

(65) Prior Publication Data

US 2019/0170106 A1 Jun. 6, 2019

Related U.S. Application Data

(63) Continuation of application No. 15/402,456, filed on Jan. 10, 2017, now Pat. No. 10,208,729.

(51) Int. Cl.

| | |
|---|---|
| ***F02N 11/12*** | (2006.01) |
| ***F02N 15/00*** | (2006.01) |
| ***F02B 63/02*** | (2006.01) |
| ***B25B 13/46*** | (2006.01) |
| ***F02N 1/00*** | (2006.01) |
| *F02N 11/14* | (2006.01) |

(52) U.S. Cl.

CPC ..... *F02N 11/12* (2013.01); *B25B 13/46* (2013.01); *F02B 63/02* (2013.01); *F02N 1/00* (2013.01); *F02N 15/006* (2013.01); *F02N 11/14* (2013.01)

(58) Field of Classification Search

CPC ..... B25B 13/06; B25B 13/065; B25B 13/46; B25B 13/463; F02B 63/02; F02N 11/12; F02N 15/006; F02N 15/022; F02N 15/023; F02N 15/025; F02N 15/026; F02N 15/027; F02N 15/028

See application file for complete search history.

(56) References Cited

U.S. PATENT DOCUMENTS

| | | | | |
|---|---|---|---|---|
| 3,040,854 | A * | 6/1962 | Rauh | F16D 41/00 192/45.1 |
| 3,136,347 | A * | 6/1964 | Linquist | B23B 31/005 408/226 |
| 3,437,083 | A * | 4/1969 | Hamman | F02N 11/12 123/179.26 |
| 3,645,247 | A * | 2/1972 | D' Ambrosio | A01D 34/6818 123/179.26 |
| 4,569,315 | A * | 2/1986 | Bodnar | F02N 11/12 123/179.26 |
| 2016/0230738 | A1 | 8/2016 | Koehler | |

* cited by examiner

*Primary Examiner* — Hung Q Nguyen

(74) *Attorney, Agent, or Firm* — Richard Malagiere, Esq.

(57) ABSTRACT

A specialty nut and specialty ratchet driver device used to start an internal combustion engine, each with an integrated one direction clutch, designed to be an attachment for a commercially available battery operated drill/driver gun. The specialty ratchet driver with an integrated one direction clutch is inserted into the driver receptacle of the socket placed over the nut on the crank shaft of the engine. One end of a drive shaft is inserted into the one direction clutch portion of the specialty ratchet driver device and the other end of the drive shaft is inserted into the chuck of a battery operated drill/driver gun. The torque of the drill/driver gun turns the crank shaft of the engine with sufficient force to initiate starting of the engine. The one direction clutch then allows the engine to turn faster than the drill/driver so as not to impede the engine start up.

2 Claims, 9 Drawing Sheets

ENGINE STARTER ATTACHMENTS FOR DRILL/DRIVER GUN

PRIORITY

This application is a continuation of and claims priority to U.S. Nonprovisional application Ser. No. 15/402,456 filed Jan. 10, 2017.

BACKGROUND OF INVENTION

Small internal combustion engines are often used to power outdoor home or farm machines including but not limited snow blowers, weed whackers, lawn mowers, tractors and chain saws. Most often these devices are started by a pull cord and spring mechanism attached to the crankshaft of the engine. Alternatively, electric starters are attached to the engine requiring either an alternating current power source (standard home power) or onboard 6 volt or 12 volt battery. When on-board electric starters are used, the on-board batteries need to be charged or the starter needs to be powered by an alternating current power source. In the case of a pull cord start small engine powered machine, this starting procedure often becomes tiresome and especially difficult with older engines or engines that have been left sitting between uses.

The present invention discloses specialty engine starter attachments with a one direction clutch inserted into it attached to an engine crank shaft. The one direction clutch accepts a shaft driver, the opposite end of the shaft driver fits into the chuck of a battery powered drill/driver gun. The one direction clutch allows the torque of the drill/driver gun to be applied to the engine crank shaft to turn the motor over while also allowing the engine to speed up faster than the drill/driver is spinning when the engine starts to allow it to run on its own.

BRIEF SUMMARY OF INVENTION

The present invention discloses a specialty engine starter nut with a one direction clutch inserted into the outward facing side attached to the threaded end of an engine crank shaft. A shaft driver is inserted into the one direction clutch in the outward facing portion of the specialty nut. The other side of the shaft driver is inserted into the chuck of a battery powered drill/driver gun. When the battery powered drill/driver gun turns the shaft driver inserted into the one direction clutch of the specialty nut screwed onto the crank shaft, it turns the crankshaft of the engine which draws fuel into the engine and moves the piston in the piston cylinder. Once the fuel air mixture ignites, the engine catches and begins to run. At this moment, when the engine begins to run on its own power—prior to the drill/driver gun with the shaft driver inserted into the chuck being removed from the one direction clutch—the engine crank shaft turns faster than the drill/driver gun. The one direction clutch accommodates this additional speed and freely spins along with the specialty nut/shaft assembly.

Commercially available battery powered drill/driver guns have gears to produce the necessary torque for the applications for which these guns are designed. This gear drive provides the torque to turn an internal combustion engine crank shaft and piston; however, this same gear drive prohibits the engine from turning faster than the drill/driver gun at the moment the engine catches and starts to run on its own. The present invention in each of its preferred embodiments is directed to a device to be used in conjunction with a commercially available battery powered drill/driver gun to start an internal combustion engine.

In a preferred embodiment of the present invention, a specialty nut with a one direction clutch pressed into the nut is attached to an engine crankshaft. One end of a shaft driver is inserted into the one direction clutch and the other end of the shaft driver is inserted into the chuck of a battery powered drill/driver gun and used to turn the engine over for starting as a by-pass or substitute for the typical pull cord found on these devices.

In another preferred embodiment, an ordinary nut is already affixed to the engine crank shaft and a specialty socket driver attachment with an integrated one direction clutch is used to engage a socket fitted on the nut. One end of a shaft driver is inserted into the one direction clutch in the specialty socket driver attachment and the other end of the shaft driver is inserted into the chuck of a battery operated drill/driver gun and used to turn the engine over. In another preferred embodiment, a square in the size of a typical ratchet driver (e.g., ⅜", ½") has a driver shaft with a one direction clutch removably inserted into a center hole in the square. In this direction, the one direction clutch can be reversed to accommodate a small engine where the crank shaft turns either clockwise or counterclockwise.

DETAILED DESCRIPTION OF INVENTION

Figure 1:
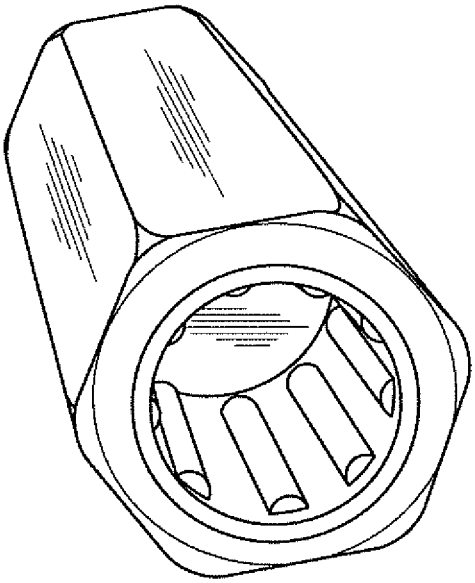
FIG. 1 is an isometric view of a preferred embodiment of the invention showing the one direction clutch.

The present invention will now be described in terms of the presently preferred embodiments thereof as illustrated in the drawings. Those of ordinary skill in the art will recognize that many obvious modifications may be made thereto without departing from the spirit or scope of the present invention.

The present invention can be used as a fixture to a battery operated drill/driver gun as a starter on any internal combustion engine which is started by turning the crank shaft while introducing fuel into the piston cylinder and an ignition source when necessary. Internal combustion engines are used to power out door maintenance machines for the home and farm. Specifically, lawn mowers, tractors, snow blowers, weed whackers and chain saws. These machines are most often started with recoil start mechanisms referred to as a pull cords. The recoil starter mechanism consists of a rope coiled around the end of the crankshaft of the machine. When the rope is pulled the crankshaft is spun and the flywheel keeps turning to start the engine.

Figure 5:
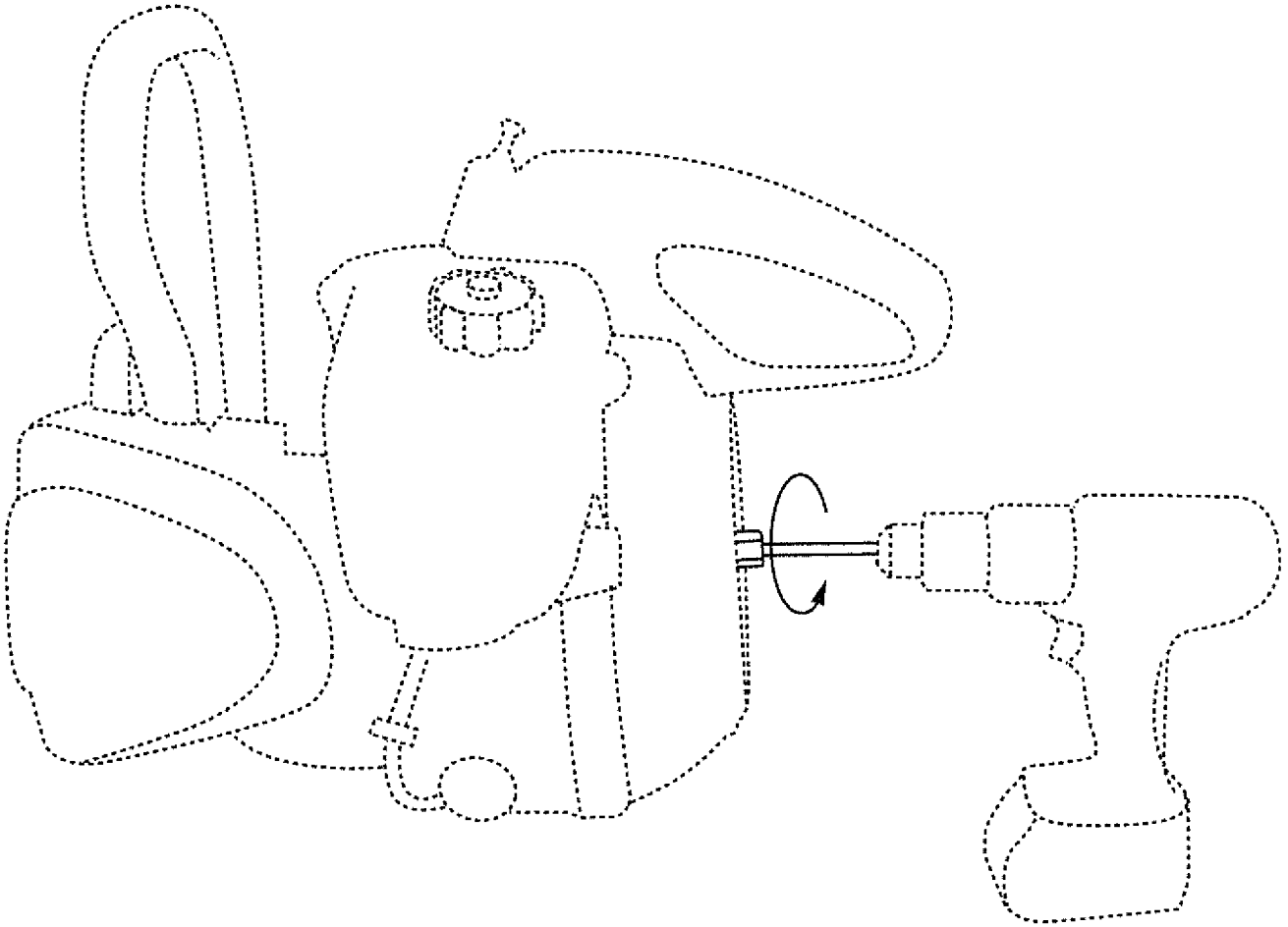
FIG. 5 is a view showing a preferred embodiment of the invention inserted into a drill/driver gun and applied to a small motor.
Figure 11:
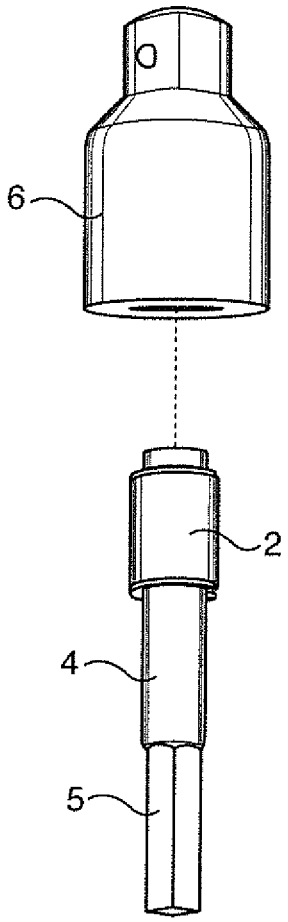
FIG. 11 is an exploded assembly view of a preferred embodiment of the present invention.
Figure 17:
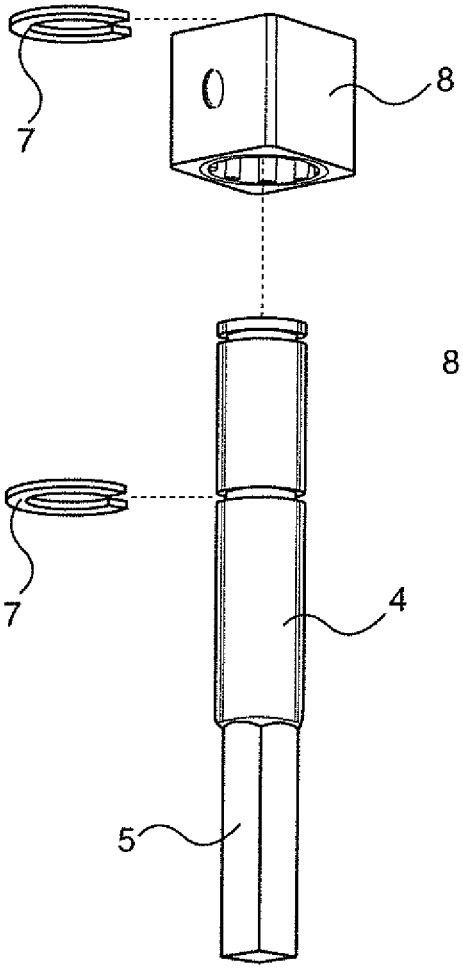
FIG. 17 is an exploded assembly view of a preferred embodiment of the present invention.
Figure 18:
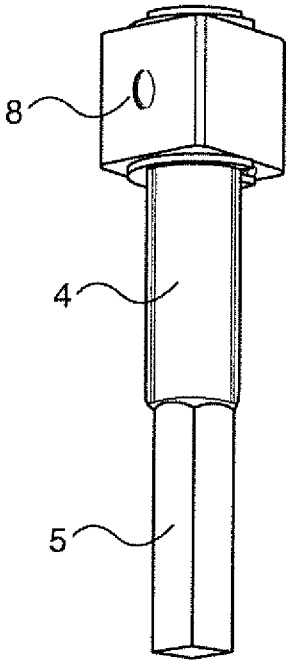
FIG. 18 is the companion assembled view of a preferred embodiment of the present invention.
Figure 19:
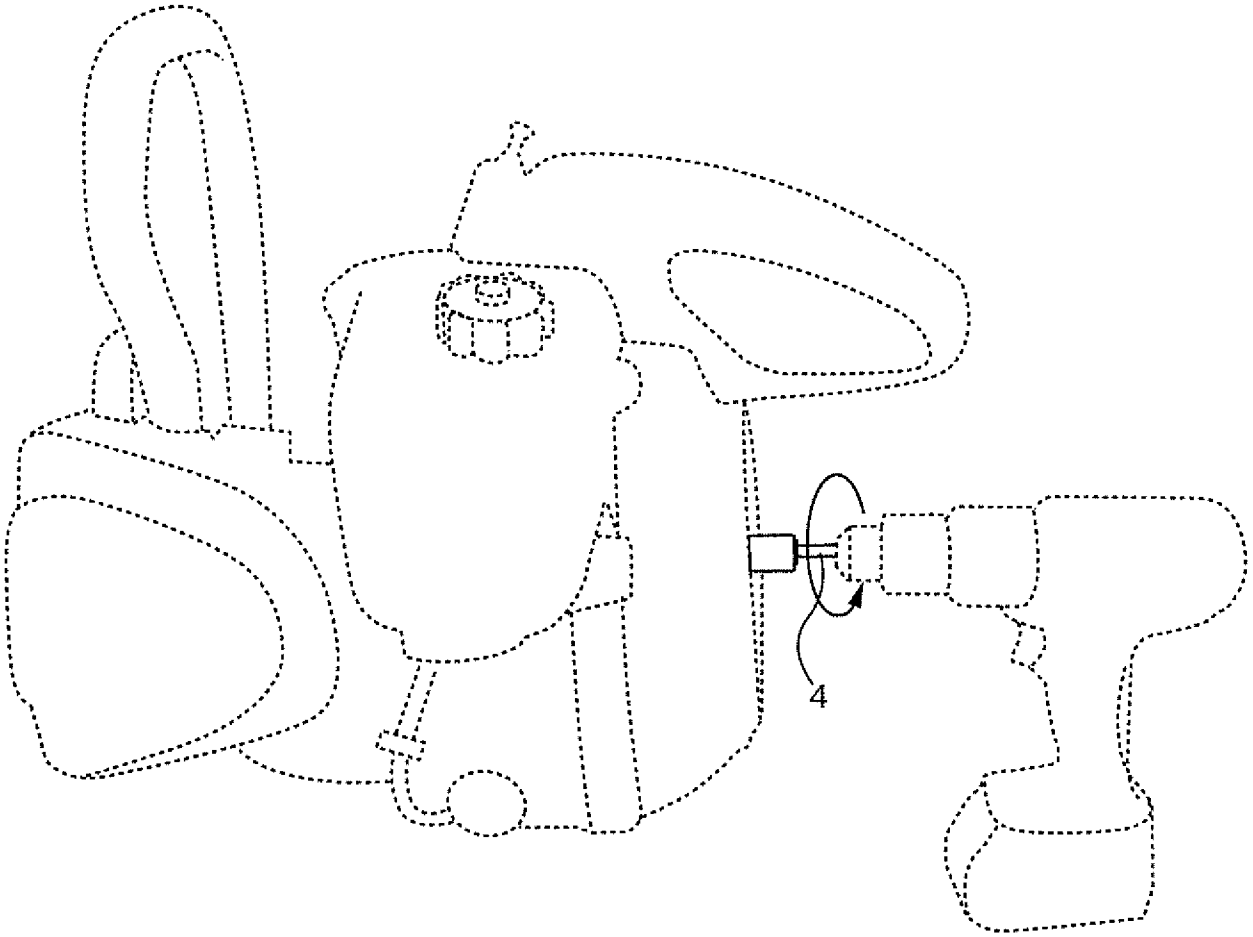
FIG. 19 is a view showing the device inserted into a drill/driver gun and applied to a small motor.

The present invention is directed to a device to be used in conjunction with a commercially available battery operated drill/driver gun. Specifically, the device in each of its preferred embodiments is a tool designed to be powered by a drive shaft set in the chuck of the drill driver/gun. FIGS. 5, 11 and 17. When affixed to the drill/driver gun, the device converts a standard battery operated drill/driver gun into a starter for an internal combustion engine.

Figure 2:
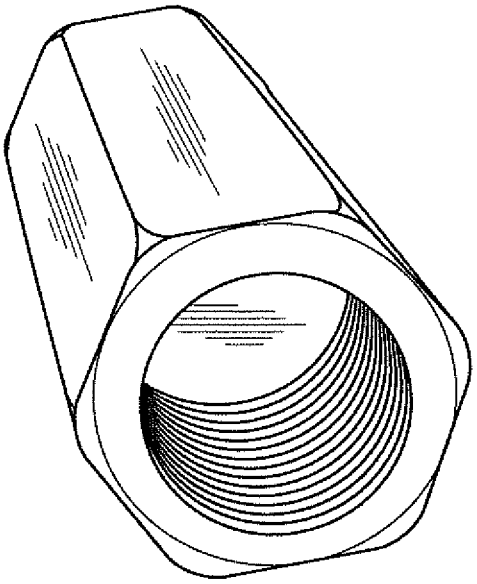
FIG. 2 is an isometric view of a preferred embodiment of the invention showing the internal threads.
Figure 3:
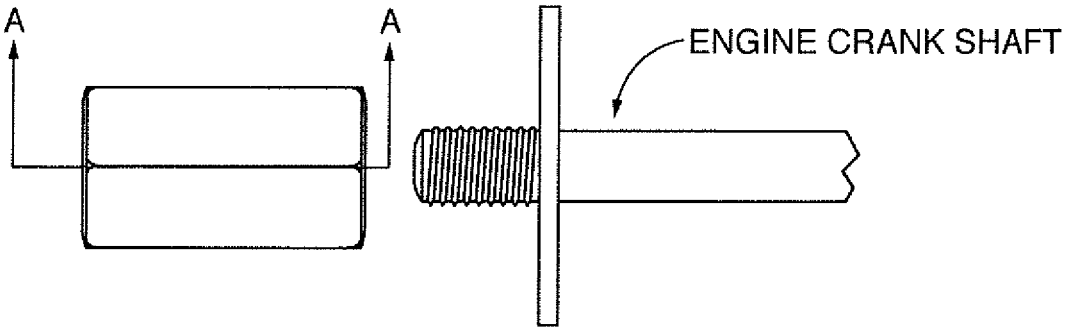
FIG. 3 is a side view of a preferred embodiment of the invention.

In a preferred embodiment, the device comprises an elongate nut (1) screwed onto the threaded crank shaft of an internal combustion engine. FIG. 1. The elongate nut has internal threads (3) on the inside diameter of one side (FIG. 2) and a commercially available miniature one direction clutch mechanism (2)—such as the one available by JTEKT Corporation—pressed into the inside diameter of the other side (FIG. 1).

Figure 4:
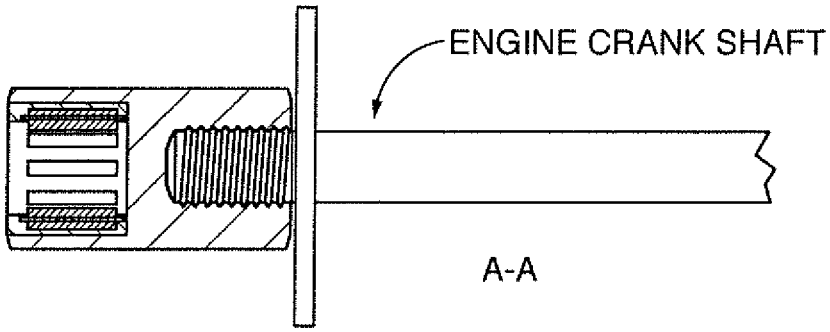
FIG. 4 is a cross section of the side view of a preferred embodiment of the invention.

Once the elongate nut is screwed onto the threaded engine crank shaft, a drive shaft (4) is inserted into the inside diameter of the one direction clutch mechanism (2). FIG. 4. The one direction clutch (2) allows motion only in the direction that the engine crank shaft is to be rotated in order to start. FIG. 5. The hexagonal end (5) of drive shaft (4) is then inserted into a commercially available battery operated drill/driver gun. FIG. 5. Of course, the hexagonal end (5) of drive shaft (4) can also be inserted into an alternating current powered drill/driver gun as well. The device is interfaced with the drill/driver gun in one of two ways. First, the hexagonal end of the device is inserted directly into the chuck of the drill/driver and then tightened down in the chuck. Second, the hexagonal end of the device is inserted directly into a hexagonal nut driver already set into the chuck of the drill/driver gun.

The drill/driver is then activated and the engine crank shaft is spun in a counterclockwise direction. FIG. 5. Once the fuel ignites, the engine begins to run and the elongate nut, crank shaft and flywheel will start to turn in the same direction as the device in the drill/driver. Without the clutch, the gears in the drill/driver required to generate the torque necessary to crank the engine, now act to interfere with the engine operating on its own power. The gears in the dill/driver act as a brake and inhibit the engine from catching and running. This phenomenon makes the use of a drill/driver gun without the use of the current invention unsuitable as a starter device for these machines.

The current invention addresses this issue by allowing the elongate nut (I) of the present invention to rotate faster than the drive shaft (4). FIG. 4. The elongate nut (1) can do this because of the one direction clutch (2) in the elongate nut (1) in which the drive shaft (4) rides. FIG. 4. and FIG. 5. The ability for the engine to spin faster than the drill/driver at the moment the engine starts is critical because the engine will not catch and continue to run on its own unless it is allowed to run up faster than the device shaft (4) attached to the drill/driver chuck at the moments the engine begins to run on its own power.

Figure 9:
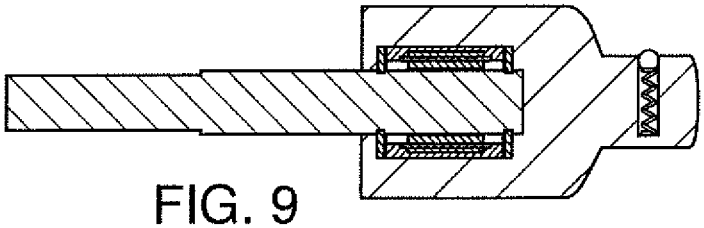
FIG. 9 is a cross section of the side view of a preferred embodiment of the invention and a drive shaft.
Figure 10:
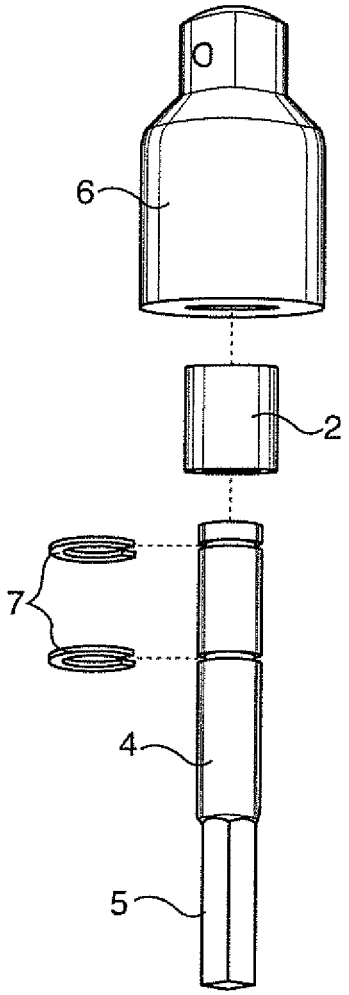
FIG. 10 is an exploded assembly view of a preferred embodiment of the present invention.

In a second preferred embodiment, the device is comprised of a socket driver attachment (6) and a drive shaft (4) with the inside diameter of a one direction clutch (2) secured onto the drive shaft (4) with snap rings (7). FIG. 10. This assembly is pressed into the inner diameter of the socket driver attachment (6). FIG. 9 and FIG. 10.

Figure 6:
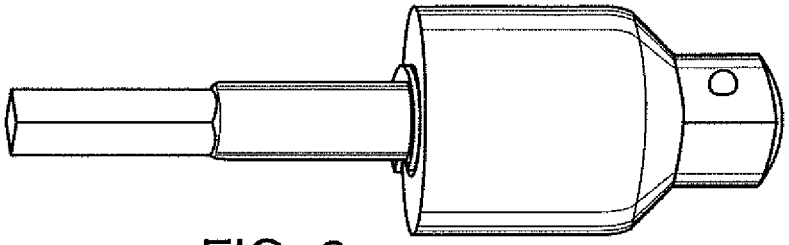
FIG. 6 is an isometric view of a preferred embodiment of the invention showing the socket driver attachment
Figure 7:
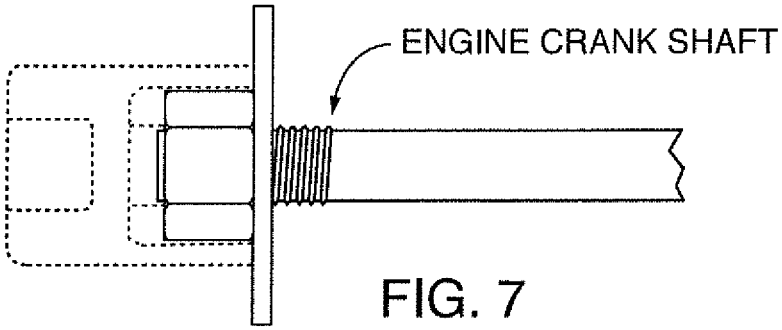
FIG. 7 is a side view of an engine crank shaft and nut with a cross section of a socket.
Figure 8:
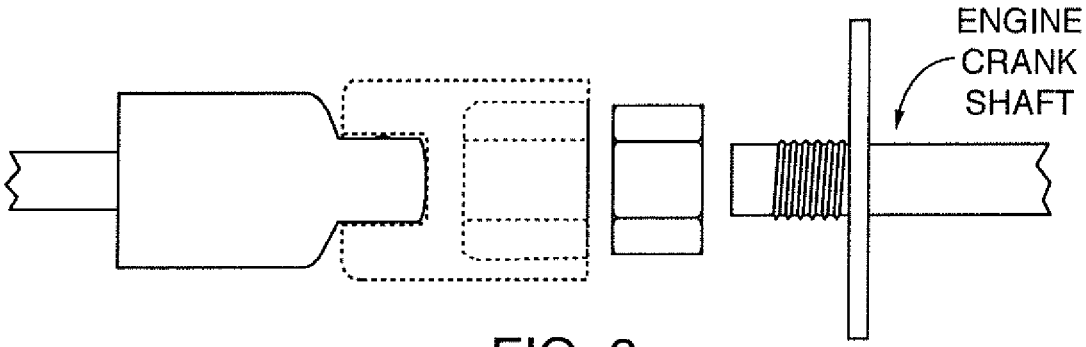
FIG. 8 is a side view of a preferred embodiment of the invention, an engine crank shaft and nut with a cross section of a socket.

In this embodiment, a socket is attached to a nut on the engine crank shaft. FIG. 7. The socket driver attachment (6) on the assembled device is inserted into the square opening at the end of the socket. FIG. 8. Any standard size socket driver can be used including 'A", ⅜", 'A" up to 3 'A" and #4 and #5 spline drives. Also, a spring loaded pin is present on the socket driver attachment (6) (FIG. 9) in order to interface with an indent present on the inside of the square opening at the end of a socket. Again, the one direction clutch (2) allows motion only in the direction that the engine crank shaft is to be rotated in order to start. FIG. 11. The hexagonal end (5) of drive shaft (4) is then inserted into a commercially available battery operated drill/driver gun. FIG. 6. The device is interfaced with the drill/driver gun in one of two ways. First, the hexagonal end of the device is inserted directly into the chuck of the drill/driver and then tightened down in the chuck. Second, the hexagonal end of the device is inserted directly into a hexagonal nut driver already set into the chuck of the drill/driver gun.

The drill/driver is then activated and the engine crank shaft is spun in a counterclockwise direction. FIG. 11. Once the fuel ignites, the engine begins to run and the elongate nut, crankshaft and flywheel will start to turn in the same direction as the device in the drill/driver. Without the clutch, the gears in the drill/driver required to generate the torque to crank the engine, now act to interfere with the engine operating on its own power. The gears in the drill/driver act as a brake and inhibit the engine from catching and running. This phenomenon makes the use of a drill/driver gun without the use of the current invention unsuitable as a starter device for these machines.

The current invention addresses this issue by allowing the socket driver attachment (6) of the present embodiment to rotate faster than the drive shaft (4). FIG. 6 and FIG. 9. The socket driver attachment (6) can do this because of the one direction clutch (2) pressed into the inner diameter of the socket driver attachment (6). FIG. 10. The ability for the engine to spin faster than the drill/driver at the moment the engine starts is critical because the engine will not catch and continue to run on its own unless it is allowed to run up faster than the drive shaft (4) attached to the drill/driver chuck at the moment the engine begins to run on its own power.

Figure 12:
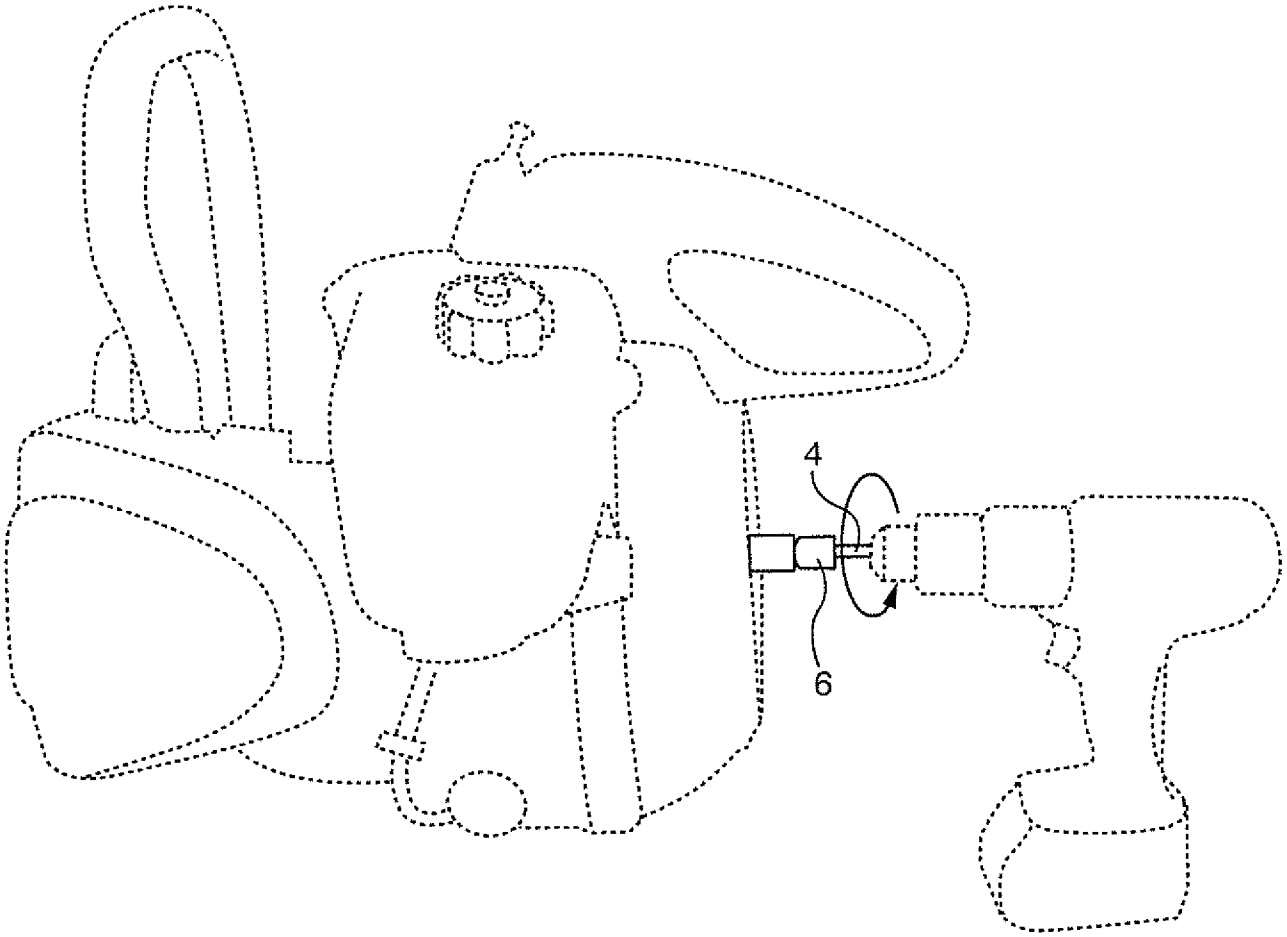
FIG. 12 is a view showing a preferred embodiment of the invention inserted into a drill/driver gun and applied to a small motor.
Figure 16:
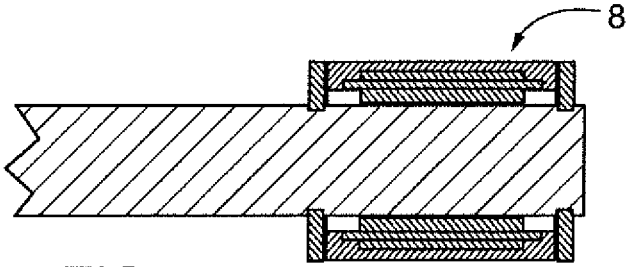
FIG. 16 is a cross section of the side view of a preferred embodiment of the invention and a drive shaft.

In a third preferred embodiment, the device is comprised of a square socket driver (8) with a one direction clutch (2) pressed into the inside diameter of the square socket driver (8). FIG. 12. A drive shaft (4) fits into the inside diameter of the one direction clutch (2) and is secured to the drive shaft by snap rings (7). FIG. 16. In this configuration, the socket driver (8) can be removed from the drive shaft (4) with relative ease and reversed and placed back on the drive shaft (4) so that the one direction clutch operates in the reverse direction. This feature allows the user of the device of this third preferred embodiment the flexibility to start engines that start by turning the engine crank shaft clockwise or counterclockwise.

Figure 13:
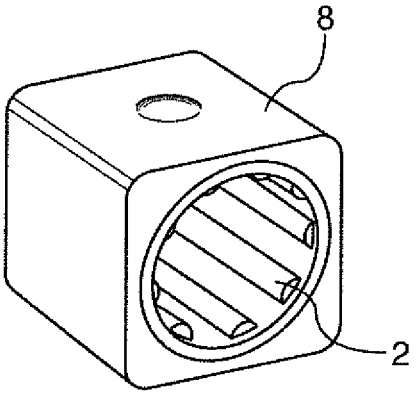
FIG. 13 is an isometric view of a preferred embodiment of the invention showing the one direction clutch.
Figure 14:
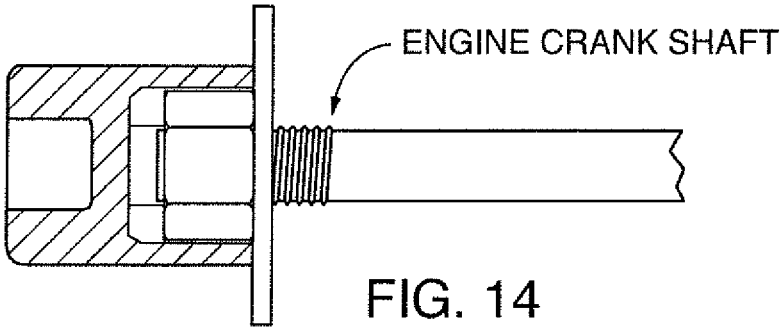
FIG. 14 is a side view of an engine crank shaft and nut with a cross section of a socket.
Figure 15:
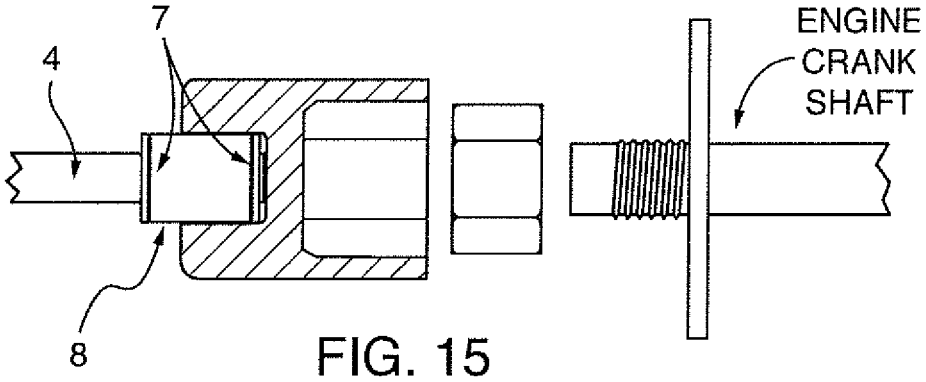
FIG. 15 is a side view of a preferred embodiment of the invention, an engine crank shaft and nut with a cross section of a socket.

In this embodiment, a socket is attached to a nut on the engine crank shaft. FIG. 13. The square socket driver (8) on the assembled device is inserted into the square opening at the end of the socket. FIG. 14. Any standard size socket driver dimension can be used for the square socket driver (8) including ¼", ⅜", ½" up to 3½". Also, an indent is present on one side of the square socket driver (FIG. 16) in order to accept a protrusion on the inside of the square opening at the end of the socket. Again, the one direction clutch (2) allows motion only in the direction that the engine crank shaft is to be rotated in order to start. FIG. 17. The hexagonal end (5) of drive shaft (4) is then inserted into a commercially available battery operated drill/driver gun. FIG. 16. The device is interfaced with the drill/driver gun in one of two directions. First, the hexagonal end of the device is inserted directly into the chuck of the drill/driver and then tightened down in the chuck. Second, the hexagonal end of the device is inserted directly into a hexagonal nut driver already set into the chuck of the drill/driver gun.

The drill/driver is then activated and the engine crank shaft is spun in a counterclockwise direction. FIG. 17. Once the fuel ignites, the engine begins to run and the square socket driver (8), crank shaft and flywheel will start to turn in the same direction as the device in the drill/driver. Without the clutch, the gears in the drill/driver required to generate the torque necessary to crank the engine, now act to interfere with the engine operating on its own power. The gears in the drill/driver act as a brake and inhibit the engine from catching and running. This phenomenon makes the use of a drill/driver gun without the use of the current invention unsuitable as a starter device for these machines. The current invention addresses this issue by allowing the square socket driver (8) of the present embodiment to rotate faster than the drive shaft (4). FIG. 16. The square socket driver (8) can do this because of the one direction clutch (2) pressed into the inner diameter of the square socket driver (8). FIG. 16. The ability for the engine to spin faster than the chill/driver at the moment the engine starts is critical because the engine will not catch and continue to run on its own unless it is allowed to run up faster than the drive shaft (4) attached to the drill/driver chuck at the moment the engine begins to run on its own power.

Those of ordinary skill in the art will recognize that the embodiments just described merely illustrate the principles of the present invention. Many obvious modifications may be made thereto without departing from the spirit or scope of the invention as set forth in the appended claims.

What is claim is:

1. An internal combustion engine starter attachment for a drill/driver gun comprising:

a nut fabricated from one piece of material with a front portion, a back portion, an outer surface and an inner surface;

a one direction clutch having an inner diameter and an outer diameter;

a drive shaft having a first end and a second end;

the outer diameter of the one direction clutch being permanently fixed into the front portion of the inner surface of the nut and the inner diameter of the one direction clutch adapted to removably receive the first end of the drive shaft;

the back portion of the nut having threads on the inner surface to attach to a threaded portion of a crank shaft of an internal combustion engine;

the second end of the of the drive shaft adapted to be inserted into a chuck of the drill/driver gun.

2. The internal combustion engine starter attachment of claim 1, wherein the second end of the drive shaft has a hex configuration.

* * * * *